US010792669B2

(12) United States Patent
Zhong

(10) Patent No.: US 10,792,669 B2
(45) Date of Patent: Oct. 6, 2020

(54) COUNTER-IMPACT JET MILLING MECHANISM AND JET MILL USING THE SAME

(71) Applicants: Wenhu Zhong, Shanghai (CN); SHANGHAI HONGJIAN AUTOMATION EQUIPMENT CO., LTD., Shanghai (CN)

(72) Inventor: Wenhu Zhong, Shanghai (CN)

(73) Assignees: Wenhu Zong, Shanghai (CN); SHANGHAI HONGJIAN AUTOMATION EQUIPMENT CO., LTD., Shanghai (CN)

( * ) Notice: Subject to any disclaimer, the term of this patent is extended or adjusted under 35 U.S.C. 154(b) by 331 days.

(21) Appl. No.: 15/579,204

(22) PCT Filed: Mar. 23, 2016

(86) PCT No.: PCT/CN2016/077073
§ 371 (c)(1),
(2) Date: Dec. 2, 2017

(87) PCT Pub. No.: WO2017/152434
PCT Pub. Date: Sep. 14, 2017

(65) Prior Publication Data

US 2018/0304273 A1 Oct. 25, 2018

(30) Foreign Application Priority Data

Mar. 7, 2016 (CN) ..... 2016 1 0127529

(51) Int. Cl.
*B02C 19/06* (2006.01)
*B02C 19/11* (2006.01)
*B02C 13/20* (2006.01)

(52) U.S. Cl.
CPC ..... *B02C 19/06* (2013.01); *B02C 13/205* (2013.01); *B02C 19/063* (2013.01);
(Continued)

(58) Field of Classification Search
CPC ..... B02C 19/06; B02C 19/063; B02C 19/065; B02C 19/066; B02C 19/068
See application file for complete search history.

(56) References Cited

U.S. PATENT DOCUMENTS 2,294,920 A * 9/1942 Lykken ..... B02C 19/005 241/39
4,176,798 A * 12/1979 Talbott ..... B02C 19/06 241/39

(Continued)

FOREIGN PATENT DOCUMENTS

CN 202162054 U 3/2012
CN 203470131 U 3/2014

(Continued)

*Primary Examiner* — Faye Francis
(74) *Attorney, Agent, or Firm* — Bayramoglu Law Offices LLC

(57) ABSTRACT

A jet milling mechanism includes an impeller with a plurality of rotating members mounted for rotation in a housing. Each rotating member has multiple negative pressure blades formed thereon for producing multiple negative pressure zones therebetween and multiple positive pressure blades formed thereon for producing multiple positive pressure zones between the positive pressure blades. The pressure blades define at least four grinding areas each distributed circumferentially about the rotating member. Each of the negative and positive pressure blades has a straight portion and an arcuate portion, and upon rotation of the impeller, the pressure blades divert material-containing air to flow into corresponding grinding areas sequentially in one direction by way of the negative pressure zone and in another direction by way of the positive pressure zone to define a (Continued)

two-phase flow. The jet milling mechanism is installed on a motor shaft of a jet mill.

4 Claims, 3 Drawing Sheets

(52) U.S. Cl.
CPC ..... *B02C 19/065* (2013.01); *B02C 19/066* (2013.01); *B02C 19/068* (2013.01); *B02C 19/11* (2013.01)

(56) References Cited

U.S. PATENT DOCUMENTS 5,542,615 A * 8/1996 Yu ..... B02C 13/14 241/199.12
7,278,595 B2 * 10/2007 Itoh ..... B02C 19/06 241/39
7,364,101 B2 * 4/2008 Tanaka ..... B02C 19/065 241/39
7,438,245 B2 * 10/2008 Kawamoto ..... B02C 19/066 241/40
7,681,814 B2 * 3/2010 Krebs ..... B02C 19/063 241/39
7,753,296 B2 * 7/2010 Makino ..... B01J 2/16 241/38
9,555,416 B2 * 1/2017 Yoshikawa ..... B02C 19/066
2003/0178514 A1 * 9/2003 Makino ..... B02C 19/065 241/5
2004/0211849 A1 * 10/2004 Itoh ..... B02C 23/02 241/39
2006/0024607 A1 * 2/2006 Tanaka ..... B02C 19/066 430/137.21
2007/0029416 A1 * 2/2007 Krebs ..... B02C 19/063 241/5
2009/0159730 A1 * 6/2009 Makino ..... B01J 2/16 241/5
2011/0073689 A1 * 3/2011 Paulat ..... C09C 3/041 241/15
2014/0183290 A1 * 7/2014 Xiao ..... B02C 13/08 241/31
2015/0069156 A1 3/2015 Lee

FOREIGN PATENT DOCUMENTS

CN 103752387 A 4/2014
CN 103752388 A 4/2014
CN 204396118 U 6/2015
CN 204724286 U 10/2015
GB 696799 A 9/1953
JP 05237411 A 9/1993

* cited by examiner

COUNTER-IMPACT JET MILLING MECHANISM AND JET MILL USING THE SAME

FIELD OF THE INVENTION

The invention relates to a high-speed, high-frequency and high-efficiency counter-impact jet milling mechanism and a jet mill using the same. In the invention, materials are crushed by using a progressive process with high-speed airflow and high-frequency impact.

DESCRIPTION OF THE RELATED ART

With the rapid development of science and technology, the research and application of ultramicro materials and nanomaterials have broad application prospects and play a very important role in promoting industrial technology progress. Generally, powder with particle size of 1 to 10 microns is called superfine powder, powder with particle size of 0.1 to 1 micron is called ultramicro powder, and powder with particle size not greater than 0.1 micron is called nano powder.

Superfine powder processing equipment and technology mainly cover mechanical impact mills, jet mills and vibrating mills. The technical equipment have a common feature that the limit particle size can only reach about 5 microns, there are certain technical and technological difficulties in meeting industrial production of superfine materials, and such problems as low yield, high energy consumption, poor environmental performance and low powder purity are common.

Mechanical impact mills and vibrating media mills are traditional mechanical grinding equipment of various mechanical types. The principle is to use mechanical energy to directly drive media to crush materials. The crushing effect is low, and it is difficult to achieve the purity requirements of powder, thus the powder fineness is inferior to that obtained by jet milling. For example, the effective crushing power of vibrating media mills is about 0.3%, while about 98% of energy is converted into heat and dissipated.

Jet mills are more advanced ultrafine crushers in the world now, mainly including the following types: flat jet mills, circulating jet mills, counter-impact jet mills, target jet mills and fluidized bed jet mills. According to *Ultrafine Grinding Classification Technology* (China Light Industry Press, 2001), jet mills have the following problems: 1. high energy consumption and low production efficiency; 2. low yield, not more than 100 kg/h in general, and less than 50 kg/h in most cases; 3. great difficulty in preparing superfine powder; and 4. complex structure and high price.

In order to solve the problems of jet mills in the prior art, those skilled in the art have tried to propose solutions.

The Chinese utility model patent with publication number of CN 204724286 discloses a solid material grinder. The solid material grinder comprises a grinding chamber, a working bin and a classifier arranged from the top down successively. A grinding body is arranged in the middle of the grinding chamber, and a liner plate is arranged on a side wall of the grinding chamber corresponding to the grinding body; the grinding body is of hollow structure, an upper material inlet is connected with a lower material outlet of the working bin, and multiple material outlets and hammering plates are arranged on the circumference; the grinding chamber and the working bin are connected through multiple ducts, and the working bin is provided with a circular air inlet; the classifier is connected with a spiral collector and a bag dust collector successively, and material outlets of the spiral collector and the bag dust collector are connected with a finished product discharge device respectively; and the material inlet of the working bin is also connected with a feed bin through a material conveyor.

Although the solid material grinder has made a slight improvement on the grinding bodies of jet mills in the prior art, there is little difference with the jet mills in the prior art, and the following problems still exist: 1. high energy consumption and low production efficiency; 2; low yield; and 3. complex structure and high price.

The applicant also filed two invention patent applications. One invention patent application with publication number of CN 103752388 discloses an environment-friendly and energy-saving eddy mill. The environment-friendly and energy-saving eddy mill comprises a grinding chamber surrounded by an external cylinder, a rotator arranged in the grinding chamber, a motor which drives the rotator spinning, a plurality of inner grinding blocks and outer grinding blocks uniformly distributed on two axial sides of the rotator circumferentially, and an internal cylinder arranged between the inner grinding blocks and the outer grinding blocks; one of the surfaces of the inner grinding blocks and the outer grinding blocks in the rotating direction is a positive pressure surface, and the other one of the surfaces is a negative pressure surface; according to the rotating direction, a negative pressure plate is arranged on each of the negative pressure surfaces of the inner grinding blocks and the outer grinding blocks; and the surfaces of the negative pressure plates, relative to the negative pressure surfaces of the inner grinding blocks and the outer grinding blocks, are arranged at certain intervals with the negative pressure surfaces of the grinding blocks; a front density cover plate and a rear sealing cover plate are respectively arranged at the front end and rear end of the external cylinder; material outlets communicated with the grinding chamber are formed in the front density cover plate and the rear sealing cover plate; and material inlets are formed in the grinding chamber. The other invention patent application with publication number of CN 103752387 discloses a milling structure of an environment-friendly and energy-saving eddy mill.

For the patents with publication number of CN 103752388 and CN 103752387, the tooth structure on the inner wall of the cylinder will produce vortex flow when the rotor shaft rotates, producing heat and increasing energy consumption of the whole mill. In addition, due to restriction of the structures of the grinding blocks, the number of inner grinding blocks in the cylinder is small, therefore, the grinding efficiency is insignificantly improved.

SUMMARY OF THE INVENTION

The purpose of the invention is to provide a high-speed, high-frequency and high-efficiency counter-impact jet milling mechanism and a jet mill using the same.

In order to achieve the purpose, one technical solution of the invention is to provide a counter-impact jet milling mechanism. The counter-impact jet milling mechanism comprises a housing, rotating members capable of rotating around an axis is arranged in the housing, and a material inlet and a material outlet are arranged on the housing. The counter-impact jet milling mechanism is characterized in that at least 4 circumferentially distributed grinding areas are arranged in the rotating members, a channel is formed between the outer edge of each of the grinding areas and the inner wall of the housing, through paths are formed at both ends of each of the channels, a material-containing airflow is defined as a two-phase flow which is ejected into negative pressure zones of the corresponding grinding areas through the through paths, negative pressure blades, positive pressure blades and two-phase flow diverters are arranged in each of the grinding areas, the sectional area of a stress surface of each of the positive pressure blades is N times that of each of the through paths, N>1, negative pressure zones are formed between adjacent negative pressure blades and between the negative pressure blades and walls of the grinding areas, positive pressure zones are formed between adjacent positive pressure blades and between the positive pressure blades and walls of the grinding areas, the positive pressure zones are arranged at the left and right sides of any of the negative pressure zones, the negative pressure zones are arranged at the left and right sides of any of the positive pressure zones, wherein the axial direction of the rotating members is defined as the front-back direction, and the horizontal direction perpendicular to the front-back direction is defined as the left-right direction;

when the rotating members spinning, the negative pressure zones produce negative pressure with the rotation of the negative pressure blades, and the positive pressure zones produce positive pressure with the rotation of the positive pressure blades, thus producing airflows; the two-phase flow formed by the material-containing airflow at least flows out of the positive pressure zone of the current grinding area from the left-right direction; the two-phase flow discharging from the right out of the positive pressure zone of the current grinding area is ejected into the negative pressure zone on the right side of the positive pressure zone and adjacent thereto through the channel and the through paths, and the negative pressure zone is arranged in the current grinding area; the two-phase flow discharging from the left out of the positive pressure zone of the current grinding area is ejected into the negative pressure zone on the left side of the positive pressure zone and adjacent thereto through the channel and the through paths, and the negative pressure zone is arranged in the next grinding area adjacent to the left side of the current grinding area; and the two-phase flow entering into the negative pressure zone is diverted by a two-phase flow diverter to the positive pressure zone of the same grinding area, forming a circulation;

For the same negative pressure zone, two two-phase flows are ejected into the negative pressure zone through the left and right through paths respectively, the speed of the two-phase flows ejected through the through paths is N times that of total airflows produced by the positive pressure blades, the two two-phase flows ejected through the left and right through paths respectively form a counter-impact jet at the inlet of the negative pressure zone, resulting in collision and crushing of materials in the two two-phase flows.

Preferably, a two-phase flow diverter is also arranged in the negative pressure zone, and the two-phase flow in the same negative pressure zone is diverted by the two-phase flow diverter to multiple positive pressure zones of the same grinding area.

Preferably, each of the grinding areas is provided with multiple blade groups in front-back layout; each blade group comprises the negative pressure blades and the positive pressure blades in left-right layout circumferentially, and two sectional induced draft blade groups in front-back layout to realize sectionalization and/or discharge; and all the groups of blades are arranged between the two sectional induced draft blade groups.

Preferably, the sectional induced draft blade groups comprise multiple sectional induced draft blades which are critical blades, or negative pressure blades to produce negative pressure airflows, or positive pressure blades to produce positive pressure airflows.

Another technical solution of the invention is to provide a counter-impact jet mill. The counter-impact jet mill comprises a motor, and is characterized in that the milling mechanism is coaxially installed on an output shaft of the motor, the milling mechanism is arranged in a shell, a feed port and a discharge port are respectively arranged on the shell, the feed port is communicated with the material inlet of the milling mechanism through a feed channel, and the discharge port is communicated with the material outlet of the milling mechanism through a discharge channel.

Another technical solution of the invention is to provide a counter-impact jet mill. The counter-impact jet mill comprises a motor, and is characterized in that the milling mechanism is respectively installed on an outer layer and an inner layer of the output shaft of the motor, i.e., an outer milling mechanism and an inner milling mechanism, the material outlet of the inner milling mechanism is communicated with the material inlet of the outer milling mechanism, the material inlet of the inner milling mechanism is communicated with the feed port through the feed channel, and the material outlet of the outer milling mechanism is in communication with the discharge port through the discharge channel.

Preferably, an air inlet is arranged on the shell, external airflow is introduced through the air inlet into the outer milling mechanism, and external airflow enters the inner milling mechanism through the feed port.

Preferably, a feedback port and a feedback inlet are arranged on the shell, the feedback port is communicated with the through path of the milling mechanism and also communicated with the closed feedback inlet through a closed pipe, and the feedback inlet is communicated with the material inlet of the inner milling mechanism.

The invention has the following advantages:

1. Low energy consumption, with energy consumption 50% lower than that of an extrusion mill, and 50% to 70% lower than a general jet mill.

2. Conforming to environmental protection requirements, negative pressure of containers, no leakage, low speed and low noise.

3. Suitable for large-scale industrial production and high yield.

4. Progressive crushing process with high-speed airflow and high-frequency impact, capable of producing fine powder to superfine powder adapting to various requirements.

5. Integrating crushing, sectionalization, air inducing and discharge with no need for sectionalizers and induced draft fans.

DESCRIPTION OF THE PREFERRED EMBODIMENT

The invention will be described in detail in combination with accompanied drawings and preferred embodiments for clear understanding.

Figure 1:
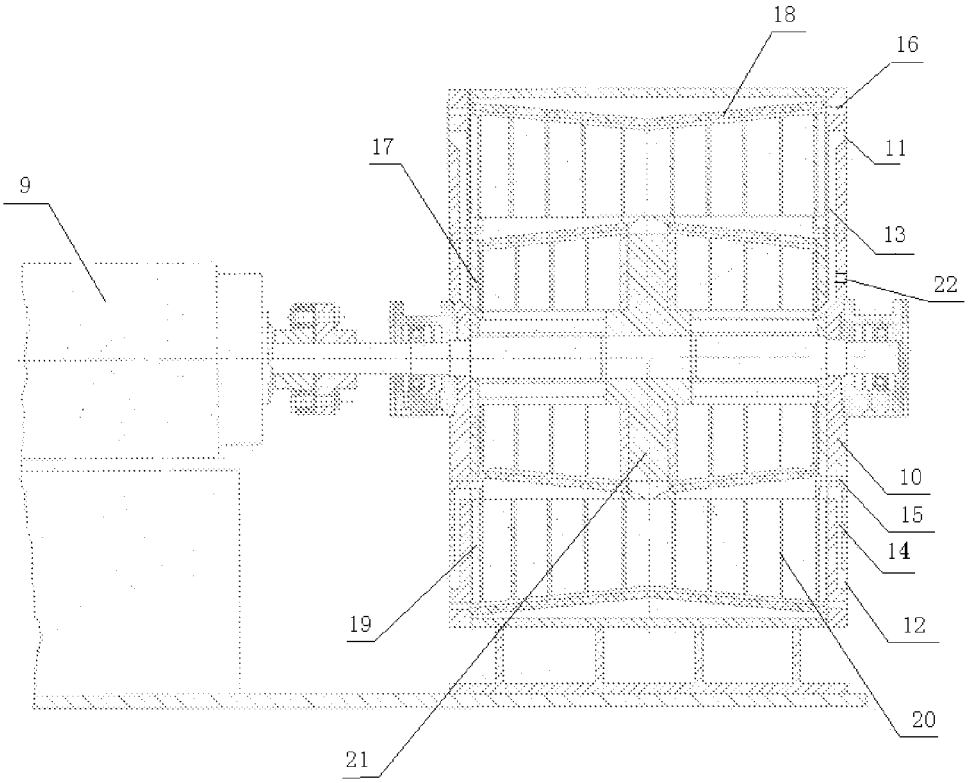
FIG. 1 is a structural diagram of a counter-impact jet mill in the invention.

As shown in FIG. 1, the invention discloses a counter-impact jet mill comprising a motor (9), an inner milling mechanism (17) and an outer milling mechanism (18) sheathed on the inner milling mechanism (17) are fixed on an output shaft of the motor (9). The inner milling mechanism (17) and the outer milling mechanism (18) are arranged in the shell (10).

The inner milling mechanism (17) and the outer milling mechanism (18) have similar structures. In the embodiment, the axial direction of the inner milling mechanism (17) and the outer milling mechanism (18) is defined as the front-back direction, and the horizontal direction perpendicular to the front-back direction is defined as the left-right direction. According to FIG. 2, the milling mechanism in the invention comprises a housing (1), and the outer ring of the housing (1) is a wearable ring. A material inlet and a material outlet (22) are arranged on the housing (1). Rotating members (8) capable of rotating around an axis is arranged in the housing (1). In the embodiment, multiple rotating members (8) in front-back layout (for the inner milling mechanism (17) in FIG. 1, FIG. 1 schematically illustrates 9 rotating members (8)) are used. The rotating members (8) are fixed on an impeller (21). According to FIG. 3, multiple circumferentially distributed grinding areas (2-1, 2-2, 2-3) are arranged in the rotating members (8). A channel (23) is formed between the outer edge of each of the grinding areas (2-1, 2-2, 2-3) and the inner wall of the housing (1), through paths (3) are formed at both ends of each of the channels (23), a material-containing airflow is defined as a two-phase flow which is ejected into negative pressure zones (6) of the corresponding grinding areas (2-1, 2-2, 2-3) through the through paths (3). Multiple negative pressure blades (4-1, 4-2, 4-3, 4-4) and multiple positive pressure blades (5-1, 5-2, 5-3, 5-4, 5-5, 5-6, 5-7) in left-right circumferential layout are arranged in each of the grinding areas (2-1, 2-2, 2-3). According to FIG. 1, rib plates (20) are fixed in front and at the rear of the negative pressure blades and positive pressure blades. The rib plates (20) of the outer milling mechanism (18) are fixed on the impeller (21) on the output shaft of the motor (9) through keys and bolts; and the rib plates (20) of the inner milling mechanism (17) are connected and fixed to the impeller (21) fixed on the output shaft of the motor (9) through screws and nuts. It should be noted that the embodiment is only an example, those skilled in the art can adjust the number of the blade groups and adjust the number of the negative pressure blades and positive pressure blades in the blade groups as required. The sectional area of a stress surface of each of the positive pressure blades (5-1, 5-2, 5-3, 5-4, 5-5, 5-6, 5-7) is some to several times that of each of the through paths (3). Negative pressure zones (6) are formed between adjacent negative pressure blades (4-1, 4-2, 4-3, 4-4) and between the negative pressure blades (4-1, 4-2, 4-3, 4-4) and walls of the grinding areas (2-1, 2-2, 2-3). Positive pressure zones (7) are formed between adjacent positive pressure blades (5-1, 5-2, 5-3, 5-4, 5-5, 5-6, 5-7) and between the positive pressure blades (5-1, 5-2, 5-3, 5-4, 5-5, 5-6, 5-7) and walls of the grinding areas (2-1, 2-2, 2-3). In the grinding area (2-1), the inventor schematically divides the negative pressure zone (6) and the positive pressure zone (7) by a dotted line, the positive pressure zone (7) is located on one side with the positive pressure blades (5-1, 5-2, 5-3, 5-4, 5-5, 5-6, 5-7) of the dotted line, and the negative pressure zone (6) is located on the other side with negative pressure blades (4-1, 4-2, 4-3, 4-4) of the dotted line.

Arcs formed at ends of the positive pressure blades (5-1, 5-2, 5-5, 5-6, 5-7) are used to divert two-phase flows from the negative pressure zones (6) to the positive pressure zones (7). Arcs formed at ends of the positive pressure blades (5-3, 5-4) are connected with arcs formed at ends of the negative pressure blades (4-2, 4-3), and also play a role in diverting two-phase flows. In addition, the negative pressure blades (4-2, 4-3, 4-4) also play a role in diverting two-phase flows, which divert two-phase flows in the negative pressure zones, and then allow the two-phase flows to uniformly flow to the corresponding positive pressure zones, improving the grinding efficiency.

Figure 2:
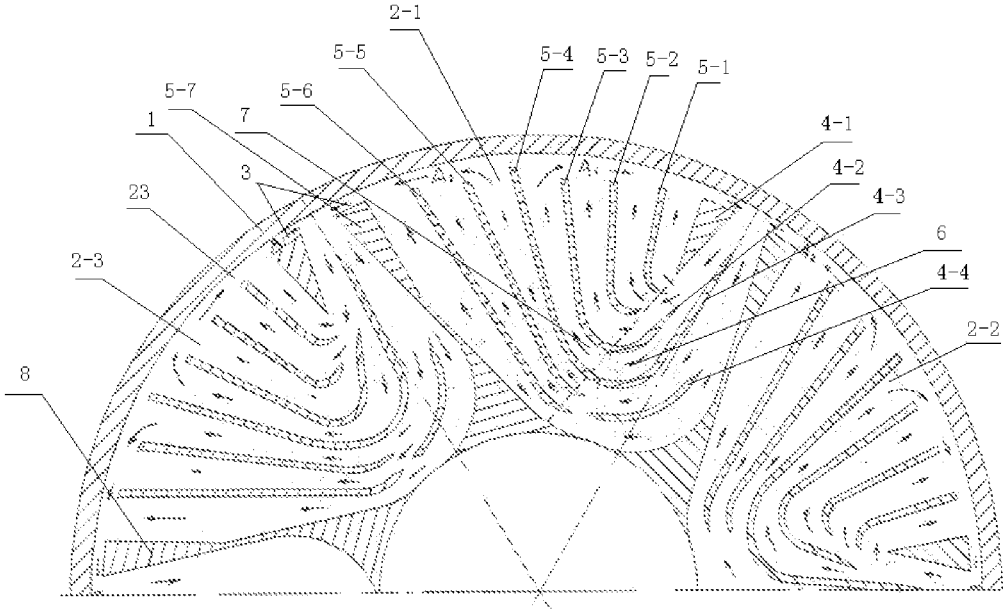
FIG. 2 is a local diagram of the counter-impact jet mill in the invention.
Figure 3:
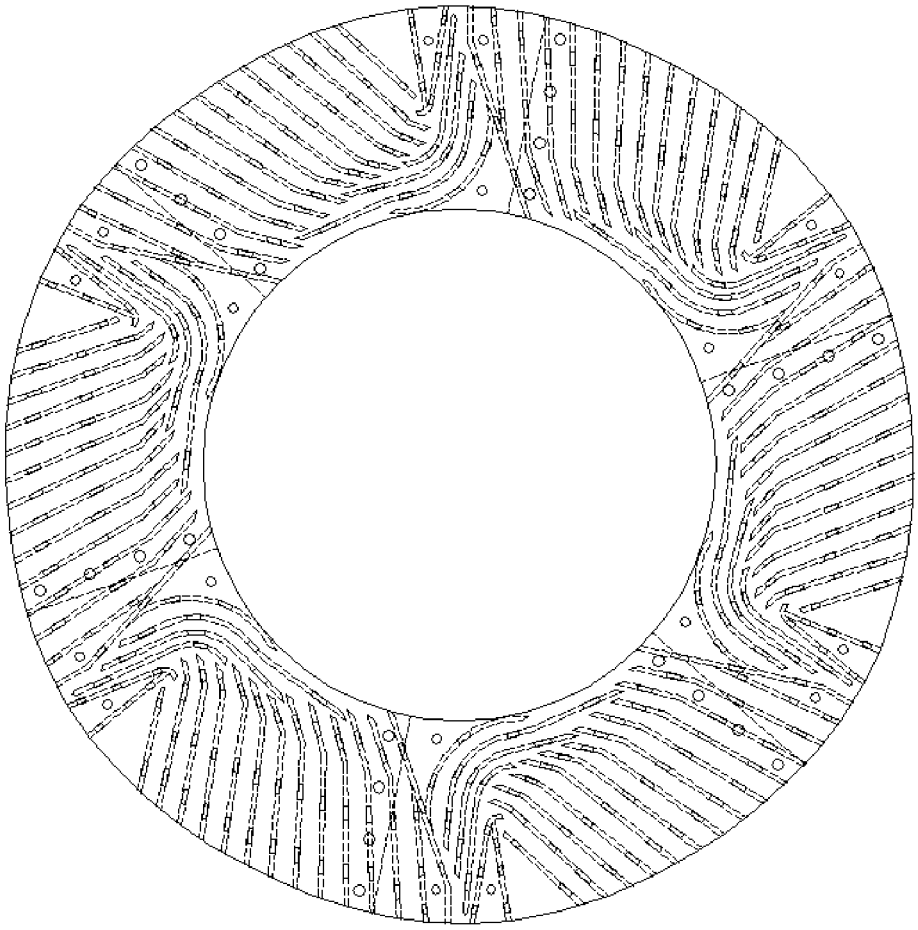
FIG. 3 is a schematic diagram of a single rotator in the invention.

The arrow in FIG. 2 illustrates the advancing direction of two-phase flows when the rotating members (8) rotate. When the rotating members (8) rotate, the negative pressure zones (6) produce negative pressure with the rotation of the negative pressure blades (4-1, 4-2, 4-3, 4-4), and the positive pressure zones (7) produce positive pressure with the rotation of the positive pressure blades (5-1, 5-2, 5-3, 5-4, 5-5, 5-6, 5-7), thus producing airflows. Then material-containing airflows are transformed into gas-sold two-phase flows, i.e., two-phase flows. The two-phase flows flow from the front, back, left and right directions. The two-phase flow flowing backward is sealed by an air seal arranged in the mill, thus the flow rate is zero. The two-phase flow flowing forward flows axially from the material outlet (22) of the outer milling mechanism (18). As the two-phase flow out of the material outlet (22) is the sum of the two-phase flows from the front and back directions, and the two-phase flow out of the section is very small and can be neglected here, the two-phase flows are mainly from the left and right directions.

After reaching the channel (23) between the positive pressure zone (7) and the wearable ring of the housing (1), the two-phase flow advances from the left and right directions by 180°. For the grinding area (2-1) shown in FIG. 2, the two-phase flow out of the positive pressure zone (7) of the grinding area (2-1) forms a flow A1 and a flow A2 respectively through the channel (23). The flow A1 flows toward the negative pressure zone (6) of the grinding area (2-1), and the flow A2 flows toward the negative pressure zone (6) of the grinding area (2-3). As the sectional area of a stress surface of each of the positive pressure blades (5-1, 5-2, 5-3, 5-4, 5-5, 5-6, 5-7) is some to several times that of each of the through paths (3), the speed of the flow A1 and the flow A2 out of the through paths (3) is some to several times that of positive pressure airflows produced by positive pressure blades (5-1, 5-2, 5-3, 5-4, 5-5, 5-6, 5-7), which can reach the speed of sound, and even higher. For the milling area (2-1), the flow A1 from the grinding area (2-1) and the flow A2 from the grinding area (2-2) form a counter-impact jet at the inlet of the negative pressure zone (6), resulting in fierce collision of materials, then the crushed flow A1 flows back to the negative pressure zone (6) of the grinding area (2-1), and the flow A2 flows to the next grinding area (2-3), forming a circulation. As the flow A1 and the flow A2 form a counter-impact jet at the junction of the positive pressure zone and the negative pressure zone, and the junction is in an approximate vacuum state, the impact speed of the flow A1 and the flow A2 is greatly increased, and the effect is very obvious. In addition, during the collision of materials at the junction, the uniformity of material quality will reach a dynamic equilibrium due to factors of speed, density and negative pressure. Assuming that the rotating members (8) rotate at a speed of 3000 rpm, and 6 grinding areas are arranged, materials in the entire milling mechanism collide for at least 3000×6=18000 times within one minute, and the efficiency is considerable.

For the mill as shown in FIG. 1, a feed port (11) and a discharge port (12) are arranged on the shell (10), and the feed port (11) is of open structure. The material outlet (22) of the inner milling mechanism is communicated with the material inlet of the outer milling mechanism, the material inlet of the inner milling mechanism is communicated with the feed port (11) through the feed channel (13), and the material outlet (22) of the outer milling mechanism is in communication with the discharge port (12) through the discharge channel (14).

A feedback port (16) and a feedback inlet are arranged on the shell (10). The feedback port (16) is communicated with the channel (23) of the outer milling mechanism and also communicated with the feedback inlet through a closed pipe, as a result, the feedback inlet forms a closed structure. The feedback inlet is communicated with the feed channel (13), and is thus communicated with the material inlet of the inner milling mechanism.

An air inlet (15) is arranged on the shell (10) and communicated with the outer milling mechanism (18). External airflow is introduced through the air inlet (15) into the outer milling mechanism (18), and external airflow enters the inner milling mechanism (17) through the feed channel (13).

A sectional induced draft blade group (19) is arranged at an end outlet of the outer milling mechanism (18). The sectional induced draft blade group (19) comprises multiple sectional induced draft blades used for sectionalization and discharge. The sectional induced draft blades can be set as critical blades, or negative pressure blades to produce negative pressure airflows, or positive pressure blades to produce positive pressure airflows as required. The three types of sectional induced draft blades are discussed respectively as follows.

When the sectional induced draft blades are set as critical blades, neither negative pressure airflow nor positive pressure airflow is produced to form a centrifugal force for materials in the airflow in the front-back direction behind the positive pressure zones of the grinding areas. If the particle size of the materials is large, the materials are sent to the feedback port (16) under the action of the centrifugal force, then pass through the closed pipe, the feedback inlet, the feed channel (13) and the material inlet of the inner milling mechanism, and finally enter the inner milling mechanism (17) and the outer milling mechanism (18) to be recrushed to smaller particle size. If the particle size of the materials is small, the materials pass through the sectional induced draft blade group (19), the material outlet (22) of the outer milling mechanism, the discharge channel (14) and the discharge port (12), and then are discharged to realize sectionalization.

When the sectional induced draft blades are set as the negative pressure blades, the sectional induced draft blades produce negative pressure, materials in the airflow in the front-back direction behind the positive pressure zones of the grinding areas are attracted by the negative pressure zones produced by the sectional induced draft blades, and pass through the sectional induced draft blade group (19), the material outlet (22) of the outer milling mechanism, the discharge channel (14) and the discharge port (12), and are finally discharged. In such case, the sectionalization effect is still present due to the action of centrifugal force, but the particle size of discharged materials is larger than the former case, the centrifugal force is adjusted to determine the particle size. and the particle size of the discharged materials is increased accordingly.

When the sectional induced draft blades are set as the positive pressure blades, the sectional induced draft blades produce positive pressure airflows, materials in the airflow in the front-back direction behind the positive pressure zones of the grinding areas cannot pass through the sectional induced draft blades, can pass through the feedback port (16), the closed pipe, the feedback inlet, the feed channel (13) and the material inlet of the inner milling mechanism, and finally enter the inner milling mechanism (17) and the outer milling mechanism (18) to be recrushed to smaller particle size. When materials have to be discharged, negative pressure is produced at the discharge port (12) by an additional discharge device, and the materials are suctioned from the discharge port (12) through the sectional induced draft blade group (19), the material outlet (22) of the outer milling mechanism and the discharge channel (14) with the help of external force. In such case, the particle size of the discharged materials is finer due to the dual action of centrifugal force and positive pressure, and the particle size depends on the positive pressure and the negative pressure produced by the discharge device.

What is claimed is:

1. A counter-impact jet milling mechanism, comprising:

a substantially cylindrical housing having opposite sides, and an inner wall connecting the sides, a material inlet and a material outlet are formed in the housing;

an impeller with a plurality of rotating members is mounted for rotation in the housing, each rotating member has multiple negative pressure blades formed thereon for producing multiple negative pressure zones between the negative pressure blades and multiple positive pressure blades formed thereon for producing multiple positive pressure zones between the positive pressure blades, the pressure blades define at least four grinding areas each distributed circumferentially about the rotating member;

a channel is formed between each of the grinding areas and the inner wall of the housing; and a through path formed at opposite ends of each of the channels, connects respectively, a negative pressure zone and a positive pressure zone; wherein each of the negative pressure blades and each of the positive pressure blades has a straight portion and an arcuate portion, and upon rotation of the impeller, the arcuate portions of the pressure blades divert material-containing air to flow into and out of corresponding grinding areas sequentially in one direction by way of a corresponding negative pressure zone and in another direction by way of a corresponding positive pressure zone to define a two-phase flow.

2. A counter-impact jet mill, comprising a motor, and wherein the milling mechanism according to claim 1 is coaxially installed on an output shaft of the motor, the milling mechanism is arranged in a shell, a feed port and a discharge port are respectively arranged on the shell, the feed port is in communication with the material inlet of the milling mechanism through a feed channel, and the discharge port is in communication with the material outlet of the milling mechanism through a discharge channel.

3. The counter-impact jet mill, comprising a motor, and the milling mechanism according to claim 2, wherein the milling mechanism is respectively installed on an outer layer and an inner layer of the output shaft of the motor, the milling mechanism further comprising an outer milling mechanism and an inner milling mechanism, a material outlet of the inner milling mechanism is in communication with a material inlet of the outer milling mechanism, a material inlet of the inner milling mechanism is in communication with the feed port through the feed channel, and a material outlet of the outer milling mechanism is in communication with the discharge port through the discharge channel.

4. The counter-impact jet mill according to claim 3, wherein an air inlet is formed in the shell, external airflow is introduced through the air inlet into the outer milling mechanism, and the external airflow enters the inner milling mechanism through the feed port.

* * * * *